United States Patent [19]

Pelz et al.

[11] 3,941,601

[45] Mar. 2, 1976

[54] PHOTOGRAPHIC SILVER HALIDE MATERIAL WHICH CONTAINS COLOR COUPLERS

[75] Inventors: Willibald Pelz, Cologne; Hans-Heinrich Credner, Hohenschaeftlarn; Walter Schulte, Opladen; Alfons Klein, Dusseldorf; Karlfried Wedemeyer; Fritz Nittel, both of Cologne, all of Germany

[73] Assignee: AGFA-Gevaert, A.G., Leverkusen, Germany

[22] Filed: Dec. 9, 1974

[21] Appl. No.: 530,719

Related U.S. Application Data

[63] Continuation-in-part of Ser. No. 342,887, March 19, 1973, abandoned.

[30] Foreign Application Priority Data

Mar. 23, 1972 Germany ..... 2214060

[52] U.S. Cl. ..... 96/100; 96/9; 96/55; 96/56.5

[51] Int. Cl.[2] ..... G03C 1/40

[58] Field of Search ..... 96/100, 55

[56] References Cited

UNITED STATES PATENTS

| | | | |
|---|---|---|---|
| 3,652,286 | 3/1972 | Credner et al. | 96/100 |
| 3,762,921 | 10/1973 | Eynde et al. | 96/100 |
| 3,770,445 | 11/1973 | Pelz et al. | 96/100 |

FOREIGN PATENTS OR APPLICATIONS

| | | | |
|---|---|---|---|
| 2,104,078 | 3/1972 | France | 96/100 |

*Primary Examiner*—J. Travis Brown
*Attorney, Agent, or Firm*—Connolly and Hutz

[57] ABSTRACT

This invention relates to a color photographic material with at least one silver halide emulsion layer having improved stability against crystallization and which contains in dispersed form a open chain keto methylene coupler a naphtholic or pyrazolone color coupler substituted with a 2-cyclo-pentyl-4-t-butyl-phenoxy group in a non-coupling position.

2 Claims, No Drawings

PHOTOGRAPHIC SILVER HALIDE MATERIAL WHICH CONTAINS COLOR COUPLERS

This application is a continuation-in-part of the copending U.S. Ser. No. 342,887 application now abandoned, filed Mar. 19, 1973, entitled "Photographic Material Which Contains Color Couplers".

This invention relates to a color photographic material containing new open chain ketomethylene naphtholic or pyrazolone color couplers which are emulsified therein.

It is known to produce colored photographic images by chromogenic development, i.e. by developing silver halide emulsion layers which have been exposed to produce an image with suitable color-forming developer substances, so-called color developers, in the presence of suitable color couplers, the oxidation product of developer substances formed in the areas of the silver image reacting with the color coupler to form a dye image. The color developers used are generally aromatic compounds which contain primary amino groups, in particular those of the p-phenylene diamine series.

The color couplers and the dyes produced from them by chromogenic development must satisfy numerous practical requirements. The color couplers should have a high rate of coupling with the oxidation product of the color developer. Both the color couplers and the dyes obtained from them should be sufficiently stable to light, elevated temperature and moisture. This applies both to the fresh material and to the processed material; for example, the residual coupler left in the image whites of the processed material should not undergo yellowing and the dyes should also be sufficiently resistant to gaseous reducing or oxidizing agents. Furthermore, they must be resistant to diffusion from the image layer and when developed by chromogenic development they should separate as a very fine grain. Lastly, the dyes produced from the color couplers by chromogenic development should have a suitable absorption curve with a maximum corresponding to the color of the desired partial image and as little side absorptions as possible; for example, a cyan dye should ideally absorb red light almost completely and be substantially transparent both to green and to blue light.

One problem which has not yet been solved completely satisfactorily in practice is that of introducing the couplers into the hydrophilic colloid layers of photographic materials in such a manner that they remain in a finely divided form without precipitating or in any other way having a deleterious effect on the photographic or mechanical properties of the layers. Hydrophobic couplers must be added to the emulsions in the form of stable dispersions. If photographic materials which contain hydrophobic couplers are stored for some time, the layers are frequently found to become cloudy due to the crystallization of the coupler. It is sometimes possible to reduce the tendency to crystallization of the color couplers by introducing certain organic radicals into the molecule of the coupler, e.g. suitably substituted phenoxy groups. Reference may be made in this connection to U.S. Pat. No. 2,423,730; 2,474,293 and 2,908,573. The color couplers described in the first and second of these three patent specifications are exclusively cyan couplers while those described in the third specification generally contain the substituted phenoxy radicals referred to above.

The cyan couplers used, i.e. color couplers which are suitable for production of the cyan partial image, are generally compounds derived from phenol or $\alpha$-naphthol. Magenta-forming couplers are generally compounds derived from 2-pyrazolone-5 or from indazolone. The yellow-forming couplers used are generally compounds derived from $\beta$-ketocarboxylic acid derivatives, e.g. benzoyl acetanilide.

A further problem to be resolved is that presented by the use of high-boiling solvents in achieving emulsification of color couplers in a photographic emulsion. In the emulsifying practice of the prior art, a coupler is solved into a certain amount of a low-boiling solvent, then a further amount of a high-boiling solvent may be added to the solution. The coupler solution is then emulsified in an aqueous gelatin solution while stirring with a suitable stirrer. Then the low-boiling solvent is left to evaporate from the emulsion. This process can be carried out by subjecting the emulsion to a treatment in vacuo at higher temperature so that the low-boiling solvent can be distilled off. Formerly the low-boiling solvents were removed from the emulsions in the drying step of the cast emulsion layers. an alternate method includes the emulsions being washed with water whereby the low-boiling solvents-which are generally to a less extent soluble in water are removed by the washing step.

If the low-boiling solvents are left in higher amounts in the layers the stability of the emulsion is rather poor since the low-boiling solvents evaporates during storage of the photographic layers and crystallization of the coupler takes places if the coupler is not highly soluble in the low-boiling solvents alone or in the low-boiling and high-boiling solvents used for emulsifying the coupler and oil-droplets containing low-boiling solvents have often a greater tendency to agglomerate in the layer than oil-droplets of high-boiling solvents.

Only a rare number of compounds are known in the art which can be emulsified by merely solving them in a low-boiling solvent without the addition of a high-boiling solvent.

The emulsification of a color coupler with a combination of a low-boiling solvent and a high-boiling solvent and the subsequent removal of the low boiling solvent results in the couplers remaining in the hydrophilic gelatin emulsion in finely dispersed form wherein the coupler molecules are enclosed in hydrophobic oil droplets. The emulsification of a color coupler with a low-boiling solvent and the subsequent removal of the low-boiling solvent results in the couplers remaining in the hydrophilic gelatin emulsion in finely dispersed form wherein the coupler molecules are enclosed to a substantial lesser extent in hydrophobic oil droplets, since only parts of the low boiling solvents remains in the layer which cannot be removed by simple means.

It has now been found that open-chain keto methylene naphtholic and pyrazolone couplers, with the 2-cyclopentyl-4-t-butyl-phenoxy radical in a non-coupling position of color coupler molecules, have excellent emulsifiability. More particularly the couplers of this invention belong to those which can advantageously be emulsified with or without the addition of a high-boiling solvent are highly soluble in low-boiling and high-boiling coupler solvents as distinguished from those which cannot be emulsified by giving stable emulsions without at least one additional high-boiling oil former. Especially the couplers of this invention if used in emulsions can be introduced into the emulsions by solving them either in low-boiling coupler solvents or in a combination of low-boiling and high-boiling coupler solvents whereby the amount of solvent used can advantageously be kept low for avoiding problems of crystallization and overburdening of the layers with coupler solvents.

This invention therefore relates to a light-sensitive color photographic material with at least one silver halide emulsion layer, which material contains a color coupler of the following formula:

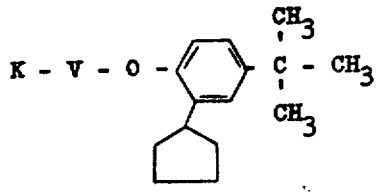

in which

K represents the radical with color coupling properties, of the α-naphthol, pyrazolone-5 or open-chain ketomethylene groups;

V represents a connecting link which links the 2-cyclopentyl-4-t.-butyl-phenoxy group with the coupler radical, in parricular a —NH—$(CH_2)_n$ or a

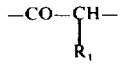

or a —CO—O—$(CH_2)_2$ group;

$R_1$ represents hydrogen or an alkyl radical preferably with up to 12 carbon atoms, particularly up to 3 carbon atoms; and

*n* equals an integer, preferably 2, 3 or 4.

If the coupler radical has an available carboxyl group through which the cyclopentyl-t.-butyl-phenoxy group is to be attached, then V preferably has the first of the meanings indicated above. If the link is to be effected by way of an amino group on the coupler radical, then V preferably has the second or third of the meanings indicated above.

The following compounds have been found to be particularly suitable color couplers:

1. 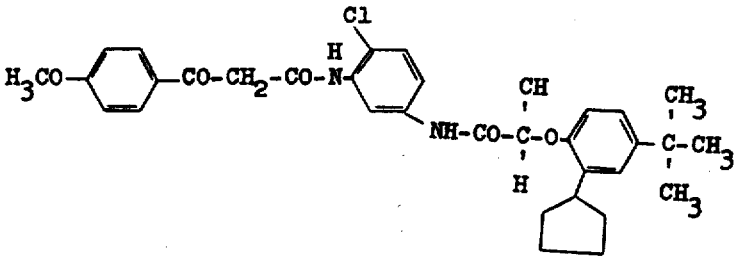

2. 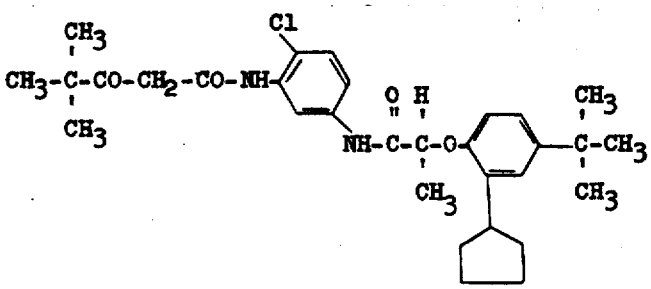

3. 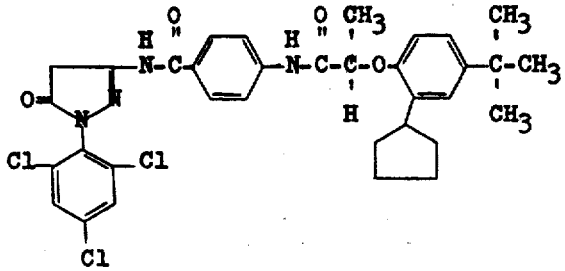

4. 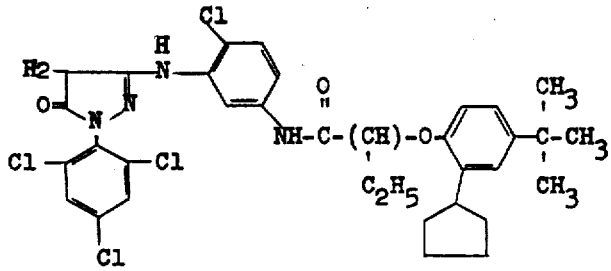

5

5.

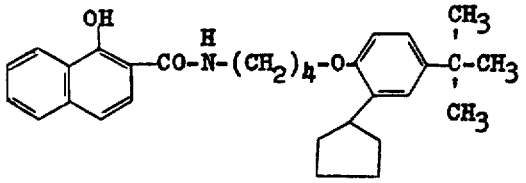

6.

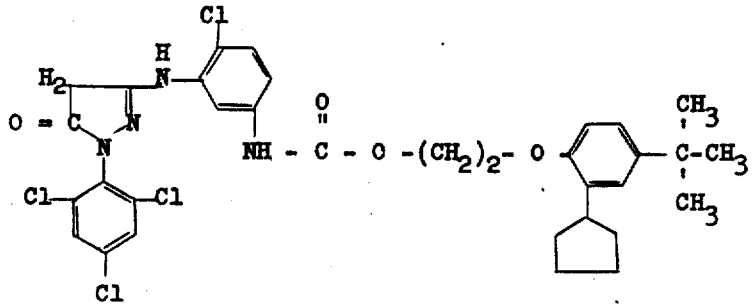

The color couplers according to the invention are prepared by the usual methods, starting from 2-cyclopentyl-4-t.-butyl-phenol. This can be obtained from phenol by successive reactions with cyclopentene and isobutene in the presence of Friedel-Crafts catalysts.

The preparation of this intermediate product will now be described in detail.

2-cyclopentyl-phenol 564 g of phenol, 204 g of cyclopentene and 15 g of $\alpha$-aluminum oxide are heated to 300°C in an autoclave for 2 hours. The catalyst is then removed by suction filtration. In the distillation which then follows, using a 1-metre packed laboratory distillation column, the first product to be recovered is unreacted phenol. This is followed, after a brief intermediate run, by 390 g of 2-cyclopentyl-phenol at $Bp_{12\ mm} = 138°C$.

4-t.-butyl-2-cyclopentyl-phenol 1134 g of 2-cyclopentyl-phenol, 1400 ml of xylene and 21 g of catalyst K 10 (trade product of Sudchemie) are introduced into an autoclave and 316 g of isobutene are then pumped in at 120°C over a period of 1½ hours. This is followed by stirring for 15 minutes at 120°C and the catalyst is then removed by suction filtration. After evaporation of the xylene, the residue is separated by fractional distillation in a 1-metre packed laboratory distillation column. The $Bp_{12\ mm}$: 172° – 174°C fraction contains 814 g of 4-t.-butyl-2-cyclopentyl-phenol.

Method of preparation of coupler 5

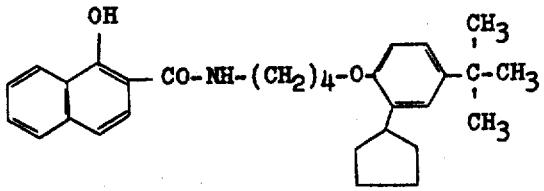

1st stage:
2-cyclopentyl-4-t.-butyl-phenoxybutyronitrile 23 g of sodium are dissolved in 600 ml of absolute alcohol. 218 g of 2-cyclopentyl-4-t.-butyl-phenol in 150 ml of alcohol are added dropwise and the mixture is then stirred for 15 minutes. 103.5 g of chlorobutyronitrile in 150 ml of alcohol are introduced dropwise and the reaction mixture is then heated under reflux for 5 hours. It is then filtered to remove sodium chloride and evaporated to dryness. The product is then fractionated at an oil bath temperature of 220° – 240°C and pressure of 0.5 mm. Yield: 220 g.

2nd stage: 2-cyclopentyl-4-t.-butyl-phenoxybutylamine 220 g of the product obtained in stage 1 are hydrogenated with Raney nickel in 3 litres of alcohol for 6 hours at 100 excess atmospheres and 120°C. The catalyst is filtered off, the alcohol is distilled off and the residue is distilled. Yield: 158 g.

3rd stage:
1-hydroxy-N-(2-cyclopentyl-4-t.-butyl-phenoxybutyl)-2-naphthamide 158 g of the product obtained in stage 2 and 144 g of phenyl 1-hydroxy-2-naphthoate are melted under vacuum at 140°C until phenol ceases to be evolved. The melt is crystallized in methanol, filtered off and recrystallized from alcohol. Yield: 151 g.

The new color couplers are found to be very suitable for use because, presumably due to their relatively low melting points, they are highly soluble in organic solvent which are immiscible with water, e.g. ethyl acetate or methylene chloride, and can readily be dispersed. Their tendency to crystallize from dispersions and emulsions is distinctly reduced even when compared with couplers of U.S. Pat. No. 3,770,445 which contain a dicyclopentylphenol radical as emulsifying radical, especially when compared with cyan coupler so that the addition of oily coupler solvents can generally be omitted. It is important to eliminate, if possible, a high boiling solvent from the layer so as to insure a high coupling activity during development. This opens up the possibility of completely utilizing the high coupling activity of the couplers since they are not enclosed in hydrophobic oil droplets. Furthermore, those couplers according to the invention which are cyan couplers can readily be combined with azo red masking couplers, e.g. those described in British Patent Specification No. 1,201,003 and British Patent Specification No. 1 322073 Excellent masking of the yellow and magenta side densities is thereby achieved.

Lastly, the color couplers of the present invention are more easily and cheaper to prepare when compared with the preparation of the couplers of the U.S. Pat. No. 3,770,445, since the destillation of the 4-t-butyl-2-cyclopentyl-phenol is more simple to perform due to their lower boiling point when compared with the destillation of the dicydopentyl-phenol.

It has also been found that compared with similar color couplers which contain open-chain aliphatic radicals in the phenol part of the molecule, the color couplers according to the invention (with a cyclopentyl and a tertiary butyl radical in the phenol part) yield much more stable dyes with hydrophilic color developers, e.g. with developers of the N-butyl-N-ω-sulfobutyl-p-phenylenediamine or 2-amino-5-(N-butyl-N-ω-sulfobutylamino)-toluene series, for example they are more stable to moist or dry heat as well as to light, particularly if paper or a polyethylene-backed paper is used as support for the photographic layers.

The compounds according to the invention are therefore valuable color couplers which on chromogenic development yield dyes which have excellent stability properties. They are eminently suitable for use in light-sensitive silver halide emulsion layers of single- or multi-layered color photographic materials. They need not necessarily be incorporated in the light-sensitive layers but could equally be accommodated in a layer of binder adjacent to a light-sensitive silver halide emulsion layer.

The couplers according to the invention may be incorporated in the silver halide emulsion or some other binder mixture by one of the known methods. Since they are so-called emulsifying couplers, i.e. hydrophobic compounds, incorporation in the photographic layers is carried out in known manner by dissolving them in suitable organic solvents such as esters of aliphatic carboxylic acids, in particular ethyl acetate or methylene chloride and then emulsifying this solution in the silver halide emulsion which is ready for casting.

The light-sensitive emulsions used may be emulsions of silver halides such as silver chloride, silver bromide or mixtures thereof, which may have a small silver iodide content of up to 10 mols%, in one of the usual hydrophilic binders such as protein, in particular gelatine, polyvinyl alcohol, polyvinyl pyrrolidone, cellulose derivatives such as carboxyalkyl cellulose, particularly carboxymethyl cellulose, or derivatives of alginic acid.

The emulsions may also be chemically sensitised, for example by adding sulfur compounds at the stage of chemical ripening, e.g. allyl isothiocyanate, allyl thiourea and sodium thiosulfate. Reducing agents may also be used as chemical sensitizers, e.g. the tin compounds described in Belgian Patent Specifications Nos. 493,464 and 568,687; polyamides such as diethylene triamine or aminomethane sulfinic acid derivatives, e.g. according to Belgian Patent Specification No. 547,323.

Noble metals such as gold, platinum, palladium, iridium, ruthenium, or rhodium or compounds of these metals are also suitable chemical sensitizers. This method of chemical sensitisation has been described in the article by R. Koslowsky, Z. Wiss. Phot. 46, 65 – 72 (1951).

The emulsions may also be sensitized with polyalkylene oxide derivaties, e.g. polyethylene oxide preferably with a molecular weight of between 1,000 and 20,000, condensation products of alkylene oxides and aliphatic alcohols, glycols or cyclic dehydration products of hexitols, alkyl-substituted phenols, aliphatic carboxylic acids, aliphatic amines, aliphatic diamines and amides. The condensation products preferably have a molecular weight of at least 700 and preferably more than 1,000. Combinations of these sensitizers may, of course, also be used for the purpose of achieving special effects, as described in Belgian Patent Specification No. 537,278 and in British Patent Specification No. 727,982.

The emulsions containing color couplers or adjacent to layers containing couplers may also contain spectral sensitizers, e.g. the usual monomethine or polymethine dyes such as acid or basic cyanines, hemicyanines, streptocyanines, merocyanines, oxonoles, hemioxonoles or styryl dyes as well as trinuclear or high nuclear methine dyes, for example rhodacyanines or neocyanines. Sensitizers of this kind have been described, for example, in the work by F. M. Hamer "The Cyanine Dyes and Related Compounds" (1964), Interscience Publishers John Wiley and Sons.

The emulsions may contain the usual stabilizers such as homopolar or salt-type compounds of mercury containing aromatic or heterocyclic rings, e.g. mercaptotriazoles, simple mercury salts, sulfonium mercury double salts and other mercury compounds. Azaindenes are also suitable stabilizers, particularly tetra- and pentaazaindenes and especially those which are substituted with hydroxyl or amino groups. Compounds of this kind have been described in the article by Birr, Z. Wiss. Phot. 47, 2 – 58 (1952). Heterocyclic mercapto compounds, among others, are also suitable stabilizers, e.g. phenyl mercaptotetrazole, quaternary benzothiazole derivatives and benzotriazole.

The emulsions may be hardened by the usual methods, for example using formaldehyde or halogenated aldehydes which contain a carboxyl group, such as mucobromic acid, diketones, methane sulfonic acid esters and dialdehydes.

The usual color developers are used for producing the dues, e.g. the usual aromatic compounds of the p-phenylene-diamine series which contain at least one primary amino group.

Suitable color developers are, for example, N,N-dimethyl-p-phenylenediamine, N,N-diethyl-p-phenylenediamine, monomethyl-p-phenylenediamine, 2-amino-5-diethylamino-toluene and 2-amino-5-(N-ethyl-N-β-methane sulfonamidoethyl-amino)-toluene. Other suitable color developers have been described, for example, in J. Amer. Chem. Soc. 73, 3100 – 3125 (1951).

Dyes which have particularly advantageous stability properties are obtained by using compounds of the following general formula as color developers:

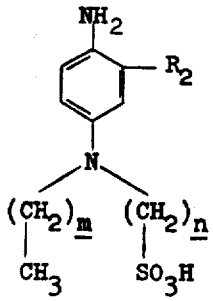

in which $R_2$ = hydrogen or methyl,
$m$ = 2, 3 or 4 and
$n$ = 2, 3, 4 or 5 with the proviso that the sum of $m$ plus $n$ equals 6 or 7.

Couplers which are emulsified with at least one additional high-boiling oil former are illustrated by the coupler of the following formula 7. 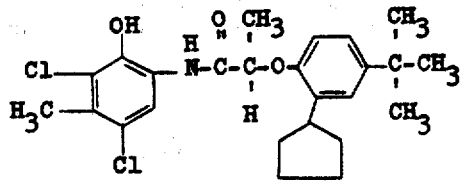

in Examples 1, 2 and 3. In Example 1 there is a comparison of the phenolic couplers with the dicyclo-pentyl-phenoxy group and the tert.-butyl-cyclo-pentyl phenoxy group.

EXAMPLE 1

Coupler 7 is compared with the coupler of the following formula

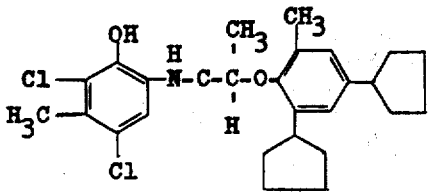

(according to U.S. Pat. No. 3,770,445) with regard to its emulsifiability. For this purpose, 23.5 g of the coupler together with 3.5 g of bis-2-ethyl-hexylester) of sulfosuccinic acid, 39.2 of a 30% aqueous solution of the monopotassium salt of iso-octadecylene-succinic acid and 47 g of a 50% solution of the monocyclo-hexanole ester of iso-pentadecylenesuccinic acid in diethyl carbonate are dissolved in 70.5 g of diethyl carbonate and emulsified at 55°C in 1 litre of a 10% aqueous gelatine solution, using a Kotthoff mixing siren as stirrer.

The emulsions obtained were compared by treating them as follows:

A) Digestion at 40°C with daily check under a polarization microscope.

| Results: | |
|---|---|
| Emulsion with coupler 7. | No crystallization observed after 6 weeks. Experiment stopped. |
| Emulsion with comparison coupler | Onset of crystallization after 10 – 12 days. |

B) Storage under refrigeration at 4°C.

| Results: | |
|---|---|
| Emulsion with coupler 7. | No crystallization after 3 months. |
| Emulsion with comparison coupler | Heavy crystallization after 2 – 3 weeks. |

In another experiment, the couplers dissolved in diethyl carbonate together with the oil-forming agents mentioned above were not emulsified in gelatine but cast on glass plates and the solvent left to evaporate. The resin remaining behind was scratched with a glass rod.

| Results: | |
|---|---|
| Coupler 7 | No crystallization after 3 days. |
| Comparison coupler | Substantially crystallized after 2½ hours. |

EXAMPLE 2

A solution of 1 g of coupler 7 in 3 g of ethyl acetate was emulsified in 20 g of 7.5% aqueous gelatine solution with the addition of 0.1 g of bis-(2-ethyl-hexylester) of sulfo-succinic acid. The resulting emulsion was mixed with 30 g of a silver bromide emulsion containing 44 g of silver per kg. After the addition of 5 ml of 1% chromium acetate solution, the emulsion was cast on a transparent support to form a layer of 5 μ in thickness. Three strips of this material were developed in three different developers after exposure behind a grey wedge.

Developer A 2.75 g of N,N-diethyl-p-phenylenediamine sulfate
1.2 g of hydroxylamine hydrochloride
2 g of anhydrous sodium sulfite
2 g of sodium metaphosphate
75 g of potassium carbonate
2 g of potassium bromide
Water up to 1000 ml

Developer B 6.5 g of N-butyl-N-ω-sulfobutyl-p-phenylenediamine
2 g of hydroxylamine hydrochloride
4 g of anhydrous sodium sulfite
100 g of potassium carbonate
1 g of potassium bromide
Water up to 1000 ml

Developer C 5 g of 2-amino-5-(N-ethyl-N-β-methane-sulfonamidoethylamino)-toluene sesquisulfate monohydrate
5 g of benzyl alcohol
2.5 g of sodium hexametaphosphate
2 g of anhydrous sodium sulfite 1.4 g of sodium bromide
0.5 g of potassium iodide
12.5 g of sodium hydroxide
34 g of $Na_2B_4O_7 \cdot 5\ H_2O$
Water up to 1000 ml.

After development, the material was bleached, fixed, washed and dried in the usual manner. The color wedges obtained were exposed to a temperature of 90°C for 24 hours. The reduction in color density based on the original color density of 0.5 was as follows:

| | |
|---|---|
| Developer A | 68% |
| Developer B | 22% |
| Developer C | 32% |

EXAMPLE 3

The material from Example 2 containing coupler 7 is developed in a developer of the following composition:

Developer D 4 g of 2-amino-5-(N-ethyl-N-hydroxyethylamino)-toluene sulfate monohydrate
2.5 g of sodium hexametaphosphate
4 g of anhydrous sodium sulfite
2 g of hydroxylamine hydrochloride
100 g of potassium carbonate
1 g of potassium bromide
Water up to 1000 ml.

Developer E is similar in composition to developer B except that the developer substance used is 6.5 g of 2-amino-5-(N-butyl-N-ω-sulfobutylamino)-toluene.

The developed materials are processed by the usual methods and then tested by the light test in which they are exposed to 5 million Lux hours. The following density losses are observed:

| | Original density D = 0.3 | D = 1.8 |
|---|---|---|
| Developer D: | 53% | 19% |
| Developer E: | 33% | 11% |

EXAMPLE 4

Photographic materials prepared by the method described in Example 2 but using 1 g of coupler 6 are developed in developers A and E. After the usual treatments following development, the resulting color wedges are subjected to the tropical test in which they are kept at 60°C and 96% relative humidity for 192 hours. The following reductions in color density based on the original density of 0.5 are observed:

| | |
|---|---|
| Developer A: | 48% |
| Developer E: | 0%. |

EXAMPLE 5

A solution of 20 g of coupler 5 in 60 ml of acetic acid ethyl ester is emulsified into 320 ml of a 10% aqueous solution of gelatin containing 11 ml of a 10% aqueous solution of saponine.

350 ml of this emulsion is stirred into 1 kg of a silver bromide gelatin emulsion containing 95 g of gelatin and 0.4 mols of silver in the form of silver bromide.

The resulting dispersion is stored for several weeks. No recrystallization occurs. The following additives are mixed with the above silver halide gelatin emulsion:

150 ml of a 5% aqueous alkaline solution of the red cyan coupler of the following formula

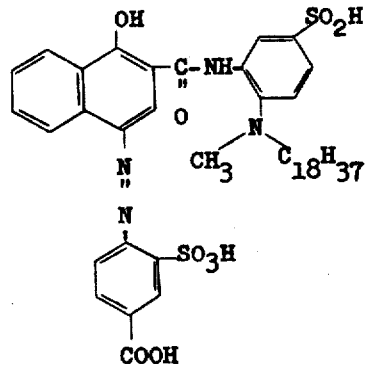

25 ml of a 1% methanolic solution of 4-hydroxy-6-methyl-1,3,3a, 7-tetraazaindene, 30 ml of a 10% aqueous solution of saponine and 15 ml of a 0.5% aqueous solution of chromium acetate.

The final emulsion is cast onto a support of cellulose triacetate. The dried layer has a thickness of 4.5 μm. The pH-value of the layer is 6.5 – 7.

The dried material is exposed in a sensitometer customarily employed in the art through a stepless grey test wedge and developed for 15 minutes in the following developer:

| | |
|---|---|
| 5 g | 2-amino-5-(N-ethyl-N-β-methan-sulfonamidoethyl-amino)-toluene-sesquisulfatmonohydrat |
| 5 ml | benzyl alcohol |
| 2.5 g of | sodium hexameta phosphate |
| 1.85 g of | sodium sulfite anhydrous |
| 1.4 g of | sodium bromide |
| 0.5 mg of | potassium iodide |
| 12.5 g of | sodium hydroxide |
| 34.2 g of | sodium tetraborate |
| Water up to 1 l. | |

The further processing includes subjecting the developed emulsion or the following bath Stop bath
17 ml of acetic acid
2.94 g of sodium acetate anhydrous
Water up to 1 l.
Hardening bath
0.3 g of sodium hydroxide
0.5 g of sodium hexametaphosphate
9 g of sodium carbonate and
20 ml of a 37% aqueous solution of formaldehyde
Water up to 1 l.
Bleaching bath
6 g of sodium hexametaphosphate
42.0 g of potassium ferricyanide
12.0 g of potassium bromide
6.0 g of disodium phosphate and
16.0 g of monopotassium phosphate
Water up to 1 l.
Fixing bath
150 g of ammonium thiosulfate
10 g of sodium sulfite
Water up to 1 l.
Final bath 0.3 g of sodium tetrapropylene benzene sulfonate
Water up to 1 l.
The processing times in the bath were as follows:

| | |
|---|---|
| Stop bath | 4 minutes |
| Hardening bath | 4 minutes |
| Rinsing | 5 minutes |
| Bleaching bath | 6 minutes |
| Rinsing | 5 minutes |
| Fixing bath | 8 minutes |
| Rinsing | 10 minutes |
| Final bath | 30 seconds |

A cyan test wedge is obtained at the exposed areas while at the unexposed areas the red dye of the masking coupler is still present. The sensitometric measurements show that the cyan dye is excellently masked in the blue and green region of the spectrum.

The naphtholic and the pyrazolone couplers with the tert.-butyl-cyclo-pentyl phenoxy group are distinctively soluble in the low-boiling coupler solvents, such as carbonic acid diethyl ester and acetic acid ethylester.

The same applies for the pyrazolone coupler with the tert.-butyl-cyclo-pentyl phenoxy group and o-tricresyl-phosphate. As to the naphtholic couplers they are highly soluble in o-tricresylphosphate and in comparison tests no relevant differences between the solubility behaviors of the couplers in o-tricresylphosphate is shown. The emulsification of the naphthol and pyrazolone couplers with the tert.-butyl-cyclo-pentyl phenoxy group is highly facilitated for the following reasons: (1) Lower amounts of low-boiling solvents can be used for the preparation of the emulsions of this invention, thus the amount of low-boiling solvents which should be removed is advantageously reduced. (2) If the addition of high-boiling solvents is needed its amount can be kept advantageously as low as wanted.

O-tricresylphosphate as well as dibutylphthalate belong to the group of the so-called high-boiling solvents, whereas carbonic acid diethyl ester, acetic acid ethyl ester or, generally, esters of aliphatic carboxylic acids and methylene chloride are used as so-called low-boiling solvents. All these solvents should be substantially unsoluble in aqueous solutions (oily solvents).

For comparison:

8.

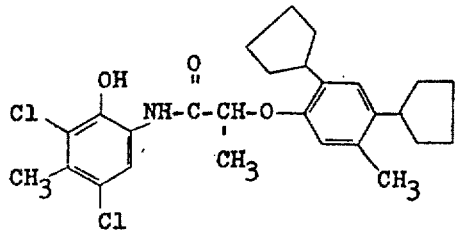

9.

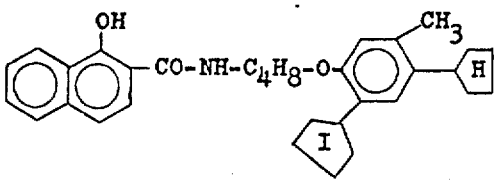

The naphtholic couplers 6 and 9 are compared with color couplers 7 and 8. The phenolic color coupler 7 does not shown an improved solubility in the color solvents if compared to the corresponding color coupler 8.

The solubility of phenolic color couplers containing the cyclopentyl-tert.-butyl-phenoxy group in common coupler solvents is heavily reduced if compared to the similar property of the phenolic color couplers containing the dicyclopentyl-phenoxy group.

While coupler 7 emulsified in gelatin layers with the combination of oil formers and coupler solvents in silver halide gelatin layers (bis(2-ethyl-hexylester of sulfosuccinic acid, monopotassium salt of iso-octadecylene-succinic acid, iso-pentadecylene succinic acid and diethylcarbonate), is superior over corresponding coupler 8 with respect to crystallization properties, the solubility of phenolic cyan couplers in common coupler solvents is much lowered if the dicyclo-pentyl-phenoxy group is replaced by the tert.-butyl-cyclopentyl-phenoxy group.

What is claimed is:

1. A color photographic gelatin silver halide emulsion having improved stability against crystallization characterized in that it contains in an organic solvent an effective amount of a color coupler of the following formula:

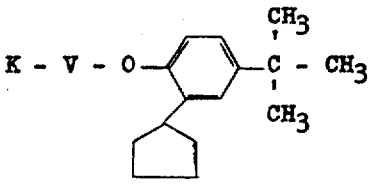

in which

K represents a radical with color coupling properties selected from the group consisting of α-naphthol, pyrazolene-5 or open-chain ketomethylene groups;

V represents a connecting link which links the 2-cyclopentyl-4-t.-butyl-phenoxy group with the coupler radical, selected from the group consisting of a $-NH-(CH_2)_n$ and a $$-CO-\underset{\underset{R_1}{|}}{CH}-$$

and a $-CO-O-(CH_2)_2$ group;

$R_1$ represents hydrogen or an alkyl radical preferably with up to 12 carbon atoms; and $n$ equals an integer, preferably 2, 3 or 4.

2. The method of producing a color photographic gelatin silver halide emulsion layer in a photographic material on a support to improve the mixing of a color coupler in the silver halide emulsion which comprises the step of emulsifying with a gelatin solution, a solution of an organic solvent and a color coupler of the following formula:

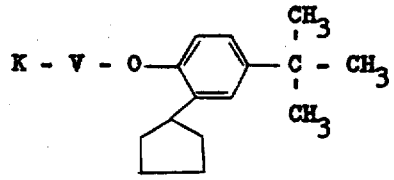

in which

K represents a radical with color coupling properties selected from the group consisting of $\alpha$-naphthol, pyrazolone-5 or open-chain ketomethylene groups;

V represents a connecting link which links the 2-cyclopentyl-4-t.-butyl-phenoxy group with the coupler radical, selected from the group consisting of a $-NH-(CH_2)_n$ and a $$-CO-\underset{\underset{R_1}{|}}{CH}-$$

and a $CO-O-(CH_2)_2$ group;

$R_1$ represents hydrogen or an alkyl radical preferably with up to 12 carbon atoms; and $n$ equals an integer, preferably 2, 3 or 4 and subsequently applying the resultant emulsion on a support.

* * * * *